US006199694B1

(12) United States Patent
Van Diest et al.

(10) Patent No.: US 6,199,694 B1
(45) Date of Patent: Mar. 13, 2001

(54) PAINT BRUSH PROTECTION SHEATH

(75) Inventors: David Albert Van Diest, 304 W. Olive Ave., Redlands, CA (US) 92373-5174; Darrell Greenland, Santa Monica, CA (US)

(73) Assignee: David Albert Van Diest, Redlands, CA (US)

( * ) Notice: Subject to any disclaimer, the term of this patent is extended or adjusted under 35 U.S.C. 154(b) by 0 days.

(21) Appl. No.: 09/442,446

(22) Filed: Nov. 18, 1999

(51) Int. Cl.[7] ..... B65D 85/00

(52) U.S. Cl. ..... 206/361; 220/4.24; 220/23.4

(58) Field of Search ..... 206/361, 362, 206/362.1, 362.4, 15.2, 15.3; 15/142, 247; 220/4.24, 23.4

(56) References Cited

U.S. PATENT DOCUMENTS

| | | | | |
|---|---|---|---|---|
| 1,612,887 | * | 1/1927 | Saunders | 206/361 |
| 2,963,150 | * | 12/1960 | Dgetluck | 206/361 |
| 2,979,189 | * | 4/1961 | Allen | 206/362.4 |
| 2,984,401 | * | 5/1961 | Herkender | 206/362.4 |
| 3,000,491 | * | 9/1961 | McIntosh | 206/361 |
| 3,136,409 | * | 6/1964 | Schumann | 206/361 |
| 3,167,178 | * | 1/1965 | Saunders | 206/361 |
| 3,981,399 | | 9/1976 | Crouch | 206/15.2 |
| 4,199,078 | * | 4/1980 | Ramirez | 220/4.24 |
| 4,207,977 | * | 6/1980 | Kronfeld et al. | 206/361 |
| 4,874,087 | | 10/1989 | Mayne | 206/362.4 |
| 5,244,090 | | 9/1993 | Keith | 206/361 |
| 5,363,959 | | 11/1994 | Crosby et al. | 206/362.4 |
| 5,465,453 | | 11/1995 | Landmeier | 15/247 |
| 5,709,301 | | 1/1998 | Couch et al. | 206/361 |

* cited by examiner

*Primary Examiner*—Jim Foster
(74) *Attorney, Agent, or Firm*—Klein & Szekeres, LLP

(57) ABSTRACT

A paint brush protection device in the form of a sheath is configured for containing the bristles and the ferrule portion of a paint brush, for keeping the bristles in proper shape and alignment. The sheath has a bristle-holding portion with an expansible bottom opening for receiving a paint brush in a handle-first orientation, and a ferrule-holding portion with an expansible top opening for allowing the handle to extend outwardly from the sheath, and for allowing the paint brush positioned within the sheath to be removed therefrom. The sheath includes front and rear sheath halves that are joined together along their sides for a portion of the length below the top opening. The part of the sheath where the sheath halves are joined together forms the ferrule-holding portion of the sheath. Between the ferrule-holding portion and the bottom opening, the sheath halves are unjoined and are resiliently separable from each other to allow the expansion of the bottom opening to receive a paint brush. The part of the sheath where the sheath halves are separable forms the bristle-holding portion of the sheath. The top opening is defined between an opposed pair of flexible flaps that are configured for engaging the handle of a paint brush positioned in the sheath, thereby securing the paint brush within the sheath. The flaps are configured to allow the brush to be pulled out of the sheath through the top opening by grasping and pulling the brush handle.

17 Claims, 2 Drawing Sheets

PAINT BRUSH PROTECTION SHEATH

BACKGROUND OF THE INVENTION

The present invention relates to devices for the protection of paint brushes. More particularly, the present invention pertains to a sheath for holding and storing a paint brush to protect the brush bristles and to keep them in their proper alignment and orientation, while allowing them to dry after cleaning.

Various types of devices for storing and protecting paint brushes are known in the prior art. See, for example, U.S. Pat. No. 5,465,453—Landmeier; U.S. Pat. No. 5,244,090—Keith; U.S. Pat. No. 5,363,959—Crosby et al.; and U.S. Pat. No. 3,981,399—Crouch. While the devices disclosed in these patents may accomplish their stated objectives to varying degrees, there is still a need for a paint brush protection device that maintains the brush bristles in their proper shape and orientation, while permitting the bristles to dry. There is also a need for such a device that is economical to manufacture and easy to use, in the sense of permitting easy and rapid installation on and removal from the brush.

SUMMARY OF THE INVENTION

Broadly, the present invention is a paint brush protection device in the form of a sheath that is configured for positioning over the bristles and the ferrule portion of a conventional paint brush for keeping the brush bristles in proper shape and alignment. The sheath has a first or bristle-holding portion with an expansible bottom opening for receiving a paint brush in a handle-first orientation, and a second or ferrule-holding portion with an expansible top opening for allowing the handle to extend outwardly from the sheath, and for allowing the paint brush positioned within the sheath to be removed therefrom.

More specifically, the sheath comprises front and rear sheath halves that are joined together along their sides for a portion of the length below the top opening. The part of the sheath where the sheath halves are joined together forms the ferrule-holding portion of the sheath. Between the ferrule-holding portion and the bottom opening, the sheath halves are unjoined and are resiliently separable from each other to allow the expansion of the bottom opening to receive a paint brush. The part of the sheath where the sheath halves are separable forms the bristle-holding portion of the sheath. The top opening is defined between an opposed pair of flexible flaps that are configured for engaging the handle of a paint brush positioned in the sheath, thereby securing the paint brush within the sheath. The flaps are configured to allow the brush to be pulled out of the sheath through the top opening by grasping and pulling the brush handle. Additionally, a pair of parallel, lateral, inwardly-directed ridges are advantageously provided within the sheath to engage the parallel raised ridges that are formed on the typical paint brush ferrule, for further securing the paint brush within the sheath. Finally, a plurality of vent openings are provided in the bristle-holding portion of the sheath, for allowing the bristles to be exposed to air to facilitate drying while the brush is held in the sheath.

The juncture between the sheath halves at the ferrule-holding portion allows the sheath halves to be resiliently and flexibly separated at the bristle-holding portion. This resilient separation not only allows the brush to be easily inserted into the sheath, but it also allows the sheath halves to spring back together against the brush bristles, firmly holding the bristles in place, and maintaining them in their proper configuration and alignment. Furthermore, the expansible top opening allows the brush to be easily and quickly removed from the sheath, while the flaps at the top opening act as retaining members that tend to keep the brush in place regardless of the orientation of the sheath.

There has thus been outlined, rather broadly, the more important features of the invention, so that the detailed description that follows may be better understood, and so that the invention's contribution to the art may be better appreciated.

Thus, as will be better appreciated from the detailed description that follows, it is an object of the present invention to provide a new and improved paint brush protection device that may be easily and economically manufactured, and thus may be offered to the consumer at low cost.

It is a further object of the present invention to provide a new and improved paint brush protection device that is of a durable and reliable construction.

Still another object of the present invention is to provide a paint brush protection device that permits the storing of a paint brush in a manner that keeps the bristles of the brush in their proper shape and alignment.

Lastly, it is an object of the present invention to provide a paint brush protection device that is configured for positioning over the bristles and the ferrule portion of a conventional paint brush for protecting the bristles and for keeping them in proper shape and alignment, while allowing them to dry after cleaning.

DESCRIPTION OF THE PREFERRED EMBODIMENT

Figure 1:
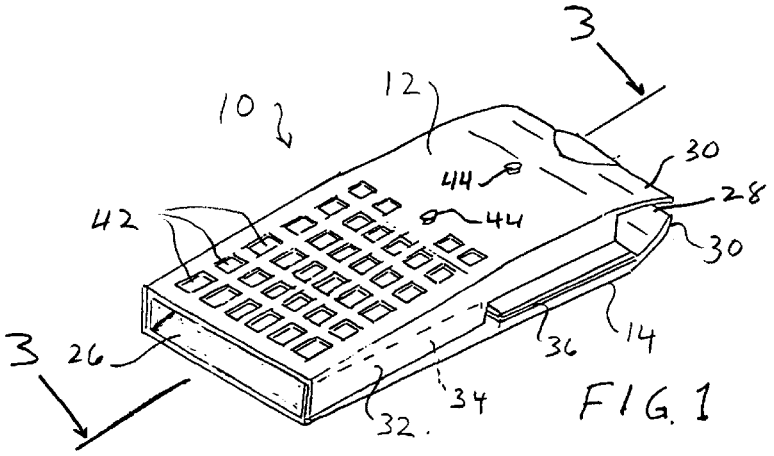
FIG. 1 is a front perspective view of the preferred embodiment of the paint brush protection device constructed in accordance with the present invention.
Figure 2:
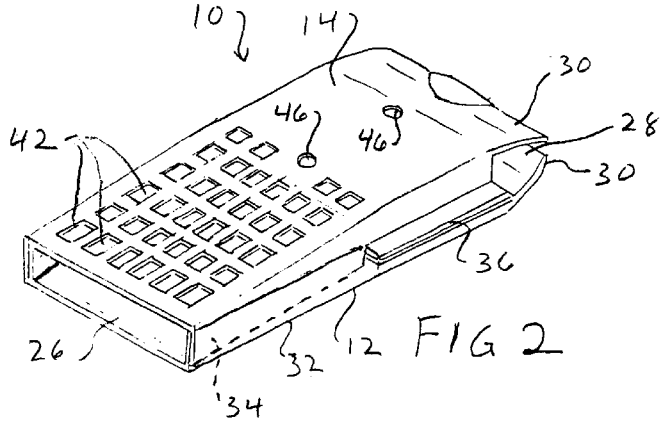
FIG. 2 is a rear perspective view of the paint brush protection device of FIG. 1.

With reference now to the drawings, a paint brush protection device, in accordance with a preferred embodiment of the present invention, is in the form of a sheath 10, comprising a front sheath half 12 and a rear sheath half 14. The sheath halves 12, 14 are preferably made of a durable plastic that has some flexibility, for reasons that will be made apparent. The sheath 10 is configured for positioning over the bristles 16 and the ferrule portion 18 of a conventional paint brush 20 (shown in phantom in FIG. 3), so as to contain and keep the bristles 16 of the paint brush 20 in proper shape and alignment by surrounding them and keeping them in proper orientation with respect to one other and the handle 22 of the paint brush 20. Preferably, the device 10 is for use with a paint brush 20 having a ferrule portion 18 with parallel lateral ridges 24 formed thereon.

The sheath 10 formed by the sheath halves 12, 14 defines a first or bottom opening 26, which is dimensioned to receive the paint brush 20 in a handle-first orientation, as will be described below. The sheath 10 also defines a second or top opening 28, through which the handle 22 of the paint brush 20 extends when the sheath 10 is installed on the bristles 16 and ferrule 18 of the paint brush 20, as described below. The top opening 28 is more specifically defined by an opposed pair of flexible flaps 30, one forming the upper end of the front sheath half 12, and the other forming the upper end of the rear sheath half 14. The flaps 30 are biased toward each other for engaging the handle 22 of a paint brush 20 when the brush 20 is positioned in the sheath 10, to secure the brush 20 therein, while allowing the brush 20 to be withdrawn from the sheath 10 by the resilient flexing of the flaps 30.

The front sheath half 12 has an opposed pair of rearwardly-projecting side walls 32, and the rear sheath half 14 has an opposed pair of forwardly-projecting side walls 34. The rearwardly-projecting side walls 32 are joined to the forwardly-projecting side walls 34 along a pair of opposed side seams 36 that extend along the sides of the sheath 10 for a portion of its length below the top opening 28. The side seams 36 may be formed by thermal or sonic welding, as would be well-known in the art of manufacturing plastic articles.

The portion of the sheath 10 in which the sheath halves 12, 14 are joined together along the seams 36 forms a ferrule-holding portion of the sheath. Between the ferrule-holding portion and the bottom opening 26, the sheath halves 12, 14 are unjoined and resiliently and flexibly separable from each other, with the side walls 32 of the front sheath half 12 overlapping the side walls 34 of the rear sheath half 14. The part of the sheath 10 in which the sheath halves 12, 14 are mutually separable forms a bristle-holding portion of the sheath 10. The ability of the unjoined sheath half portions to be resiliently separable from each other allows the expansion of the bristle holding portion of the sheath 10 and its bottom opening 26, thereby facilitating the installation of a paint brush into the sheath 10, while also effecting a clamping action on a brush contained therein.

Figure 3:
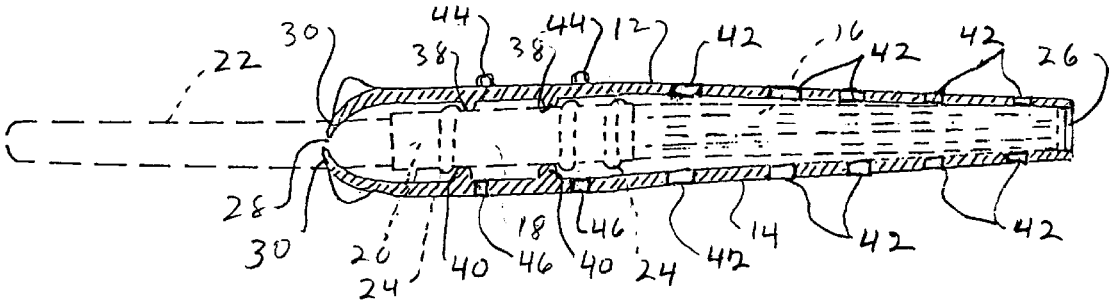
FIG. 3 is a longitudinal cross-sectional view taken along line 3—3 of FIG. 1.

The sheath half 12 may advantageously include a first parallel pair of lateral ridges 38 extending from its interior surface in the ferrule holding portion of the sheath 10. Similarly, a second parallel pair of lateral ridges 40 are advantageously provided on the interior surface of the rear sheath half 14 in the ferrule-holding portion of the sheath. The ridges 38, 40 are oriented transversely to the longitudinal axis of the sheath 10. The first and second pairs of lateral ridges 38, 40 are longitudinally offset from each other, and are spaced within the ferrule-holding portion of the sheath 10 so as to engage the lateral ridges 24 that are typically provided on the brush ferrule 18, as shown in FIG. 3, thereby providing additional means for securing the paint brush within the housing.

The portions of the sheath halves 12, 14 that form the bristle holding portion of the sheath 10 advantageously include a plurality of vent holes 42. The vent holes 42 expose the bristles 16 of a brush 20 contained within the sheath 10 to ambient air to hasten the drying of the bristles 16 after cleaning with paint thinner or water (depending on the type of paint used).

It may be advantageous to provide means for attaching two or more sheaths 10 together to make it handier to carry two or more paint brushes at once. To this end, the front sheath half 12 may be provided with a pair of longitudinally-spaced locking studs 44, and the rear sheath half 14 may be provided with a pair of sockets 46 that register with and receive the studs 44 of a second sheath (not shown). Thus, two or more sheaths 10 can be removably attached to one another in a front-to-back relationship, whereby two or more brushes contained within the attached sheaths can be carried together.

Figure 4:
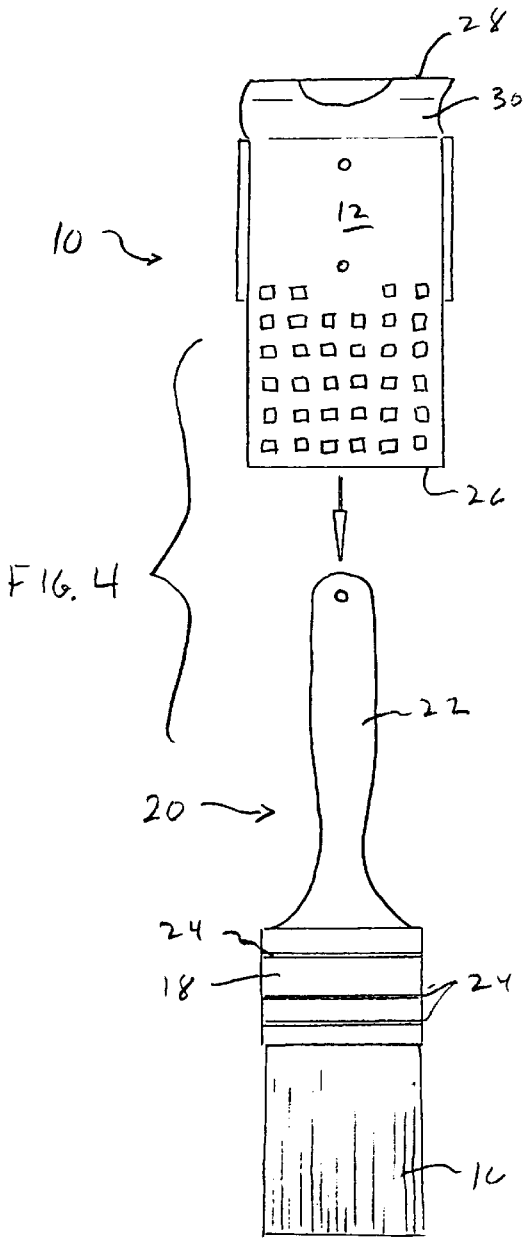
FIG. 4 is a front elevational view of the paint brush protection device of FIG. 1 and a typical paint brush, showing how the paint brush protection device is installed on the paint brush.
Figure 5:
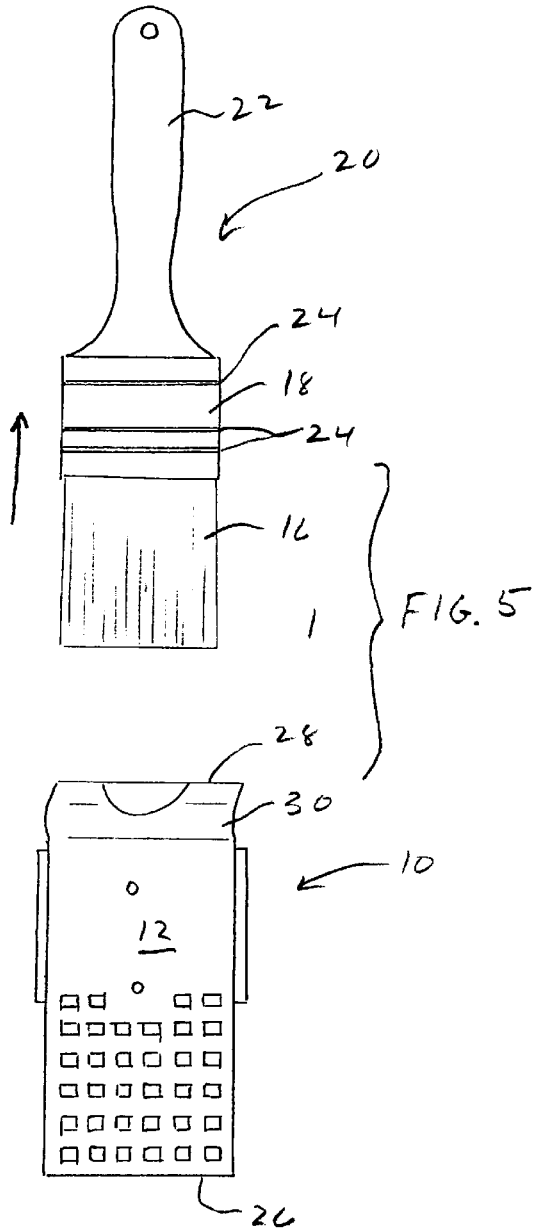
FIG. 5 is a front elevational view, similar to that of FIG. 4, showing the removal of the brush from the paint brush protection device.

FIGS. 4 and 5 illustrate the method of using the sheath 10 in accordance with the present invention. FIG. 4 shows the protective sheath 10 of the present invention positioned for installation on a typical paint brush 20. The sheath 10 is first positioned so that the bottom opening 26 receives the brush handle 22, and the sheath 10 is then pushed down over the brush 20 until the sheath 10 is installed on the brush 20 as shown in FIG. 3. When the sheath 10 is so installed, the bristles 16 are constrained within the bristle-holding portion of the sheath 10, the ferrule 18 is held within the ferrule-holding portion, and the brush handle 22 extends out of the top opening 28.

The ability of the sheath halves 12, 14 to separate resiliently allows the bottom opening 26 and the bristle-holding portion of the sheath 10 to expand to allow the ferrule 18 of the brush 20 to pass through to the ferrule-holding portion of the sheath 10. When the brush 20 is installed in the sheath 10, as shown in FIG. 3, the flexible resilience of the sheath halves 12, 14 in the bristle-holding portion causes the sheath halves 12, 14 to spring back to their original configuration, clamping the bristles 16 between them to maintain the bristles 16 in their proper alignment and orientation. The brush 20 is secured within the sheath 10 by this clamping action, by the engagement of the interior lateral ridges 38, 40 of the ferrule-holding portion with the external lateral ridges 24 on the brush ferrule 18, and by the engagement of the top opening flaps 30 with the brush handle 22.

FIG. 5 shows the removal of the brush 20 from the sheath 10. The handle 22 is grasped, and the brush 20 is pulled through the top opening 28 of the sheath 10. The top opening flaps 30 flexibly yield to expand the top opening 28, thereby allowing the ferrule 18 and the bristles 16 of the brush 20 to pass through it.

Thus, the paint brush protection sheath 10 is designed so that the brush 20 can be inserted into the bottom opening 26 handle first, and also removed from the top opening 28 of the sheath 10 handle first. This unidirectional movement for both installation and removal is important because it forces the bristles 16 into alignment during the insertion procedure, and it does not cause the bristles 16 to become misaligned during removal from the sheath.

From the foregoing description, it can be appreciated that the present invention provides good protection for the bristles of a paint brush, keeping them properly aligned and oriented during storage, while allowing them to dry efficiently and quickly. These advantages are provided in a structure that may be economically manufactured from inexpensive molded plastic, thereby allowing the cost to be kept sufficiently low so that the sheath can be disposable.

While a preferred embodiment has been described herein, it will be understood that a number of modifications and variations will suggest themselves to those skilled in the pertinent arts. Such modifications and variations should be considered within the spirit and scope of the present invention, as defined in the claims that follow.

What is claimed is:

1. A protective sheath for a paint brush, comprising:

a front sheath half having a pair of rearwardly-extending side walls;

a rear sheath half having a pair of forwardly-extending side walls; and means on the front and rear sheath halves for removably attaching a second sheath to the sheath in a front-to-back relationship;

wherein the front and rear sheath halves are joined together along a portion of the rearwardly-extending side walls and a portion of the forwardly-extending side walls so as to define a top opening and a bottom opening between the front and rear sheath halves.

2. The protective sheath of claim 1, wherein each of the rearwardly-extending side walls and the forwardly-extending side walls has a length extending from the top opening to the bottom opening;

wherein each of the rearwardly-extending side walls is joined to an adjacent one of the forwardly-extending side walls along a seam extending along a portion of the length adjacent the top opening; and wherein each of the rearwardly-extending side walls is flexibly separable from the adjacent one of the forwardly-extending side walls along a portion of the length adjacent the bottom opening.

3. The protective shield of claim 1, wherein the top opening is defined by an opposed pair of flexible flaps.

4. The protective sheath of claim 3, wherein one of the flaps is integral with the front sheath half, and the other of the flaps is integral with the rear sheath half.

5. The protective sheath of claim 1, wherein each of the front and rear sheath halves is provided with a plurality of vent holes.

6. The protective sheath of claim 1, wherein the means for removably attaching comprises:

a pair of locking studs protruding from the front sheath half; and a pair of sockets on the rear sheath half, located and dimensioned to receive the locking studs of the second sheath.

7. A device for protecting a paint brush having a handle, a ferrule portion, and bristles, the device comprising:

a sheath having a top opening, a bottom opening, a ferrule-holding portion, and a bristle-holding portion, the ferrule-holding portion being located between the top opening and the bristle-holding portion, and the bristle-holding portion being located between the ferrule-holding portion and the bottom opening, the sheath comprising a front sheath half and a rear sheath half joined together at the ferrule-holding portion;

wherein the top opening is sized to receive the handle of the brush; and wherein the bottom opening and the bristle-holding portion are sized to receive the bristles of the brush and are resiliently expansible to allow the ferrule portion of the brush to pass through the bottom opening and the bristle-holding portion to the ferrule-holding portion.

8. The device of claim 7, wherein the top opening is defined between an opposed pair of flexible flaps.

9. The device of claim 7, wherein the front sheath half includes a pair of rearwardly-extending side walls, and the rear sheath half includes a pair of forwardly-extending side walls; and wherein the front and rear sheath halves are joined together along a portion of the rearwardly-extending side walls and a portion of the forwardly-extending side walls between the top opening and the bristle-holding portion.

10. The device of claim 9, wherein each of the rearwardly-extending side walls and the forwardly-extending side walls has a length extending from the top opening to the bottom opening;

wherein each of the rearwardly-extending side walls is joined to an adjacent one of the forwardly-extending side walls along a seam extending along a portion of the length adjacent to the top opening; and wherein each of the rearwardly-extending side walls is flexibly separable from the adjacent one of the forwardly-extending side walls along a portion of the length adjacent the bottom opening.

11. The device of claim 7, wherein the top opening is defined between an opposed pair of flexible flaps, one of the flaps being integral with the front sheath half, and the other of the flaps being integral with the rear sheath half.

12. The device of claim 7, wherein each of the front and rear sheath halves is provided with a plurality of vent holes.

13. The device of claim 7, further comprising means on the front and rear sheath halves for removably attaching a second device to the device in a front-to-back relationship.

14. The device of claim 13, wherein the means for removably attaching comprises:

a pair of locking studs protruding from the front sheath half; and a pair of sockets on the rear sheath half, located and dimensioned to receive the locking studs of the second device to be removably attached to the device.

15. The device of claim 7, further comprising means in the ferrule-holding portion for engaging the ferrule portion of the brush.

16. The device of claim 15, wherein the means in the ferrule-holding portion comprises a plurality of parallel, lateral, inwardly-directed ridges.

17. The device of claim 16, wherein the means in the ferrule-holding portion comprises:

a first pair of parallel lateral ridges in the front sheath half; and a second pair of parallel lateral ridges in the rear sheath half, longitudinally offset from the first pair.

* * * * *